United States Patent [19]

Gross et al.

[11] 4,193,145

[45] Mar. 18, 1980

[54] TOILET FLUSHING VALVE MECHANISM

[75] Inventors: Gary Gross; James F. Thies, both of N. Hollywood, Calif.

[73] Assignee: Garon Processing Co., North Hollywood, Calif.

[21] Appl. No.: 920,570

[22] Filed: Jun. 29, 1978

[51] Int. Cl.[2] ..... E03D 1/36; F16K 31/18

[52] U.S. Cl. ..... 4/346; 4/366; 4/379; 4/394; 4/397; 4/405; 137/410; 137/624.14

[58] Field of Search ..... 4/324, 325, 333, 339, 4/340, 345, 353, 354, 360, 361, 366, 367, 378, 379, 388, 394, 397, 398, 401, 405, 407, 411, 412, 250, 374, 346; 137/624.11, 624.14, 410, 429, 433

[56] References Cited

U.S. PATENT DOCUMENTS

| | | | |
|---|---|---|---|
| 789,962 | 5/1905 | Callahan | 4/250 X |
| 2,448,231 | 8/1948 | Molloy | 4/407 |
| 2,492,436 | 12/1949 | Owens | 4/374 |
| 2,587,901 | 3/1952 | Robinson | 4/398 |
| 3,517,684 | 6/1970 | Mitchell | 137/624.14 X |
| 3,780,384 | 12/1973 | Rivelle | 4/367 |
| 3,896,854 | 7/1975 | Utchell | 137/624.14 |
| 4,052,756 | 10/1977 | Whiteman, Sr. et al. | 4/345 |
| 4,114,208 | 9/1978 | Imler | 4/366 |

*Primary Examiner*—Stuart S. Levy

*Attorney, Agent, or Firm*—Nilsson, Robbins, Dalgarn, Berliner, Carson & Wurst

[57] ABSTRACT

A flushing mechanism is disclosed for use in the tank of a toilet, utilizing a spool valve to accommodate various fluid pressures and to accomplish accurate control of volumetric flow. A housing is provided in the toilet tank, defining an inlet port which is adapted to be connected to the source of flushing fluid, e.g. water, and also defining a vertical valve chamber extending somewhat transverse to the inlet port and connected to control the discharge of water from the valve and out of the tank to the toilet bowl. The spool valve is provided in the valve chamber such that the facing surfaces of lands on the spool are subjected to the pressure of the flushing water source, to maintain a balance. Manual means is disclosed for displacing the spool valve to supply flushing water from the source while activating a hydraulic timer which, in due course, resets the spool valve. In the disclosed embodiment, the hydraulic timer involves a bleed tube for supplying water to the tank which contains a float. Upon completion of the flushing operation, effected by the float reaching a predetermined level, the bleed tube supplies water from the tank to the bowl, restoring the water level in the bowl to the threshold of flushing.

3 Claims, 4 Drawing Figures

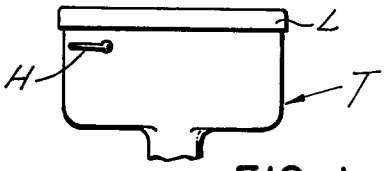
FIG. 1
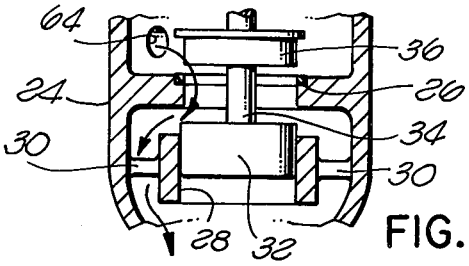
FIG. 4
FIG. 2
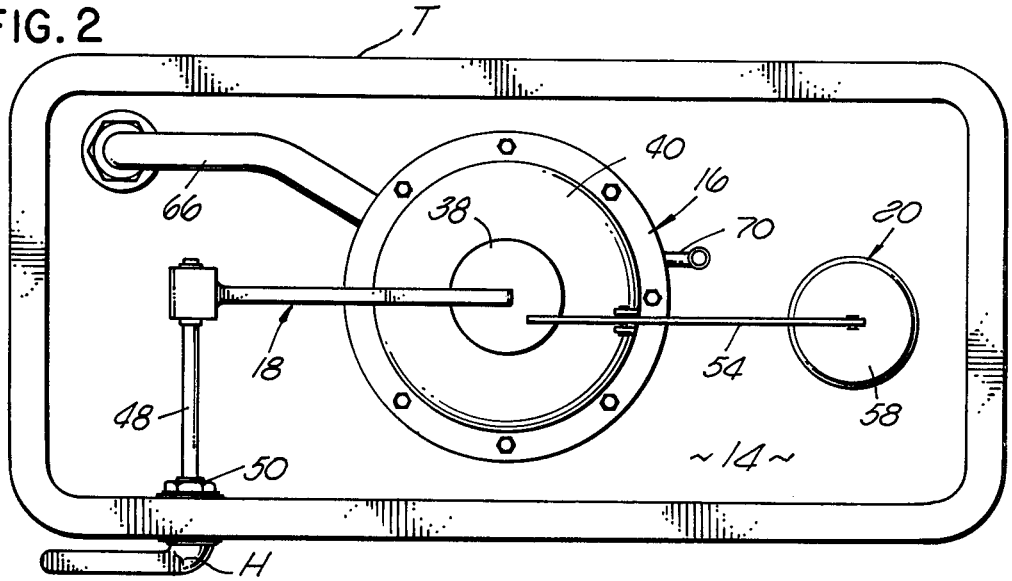
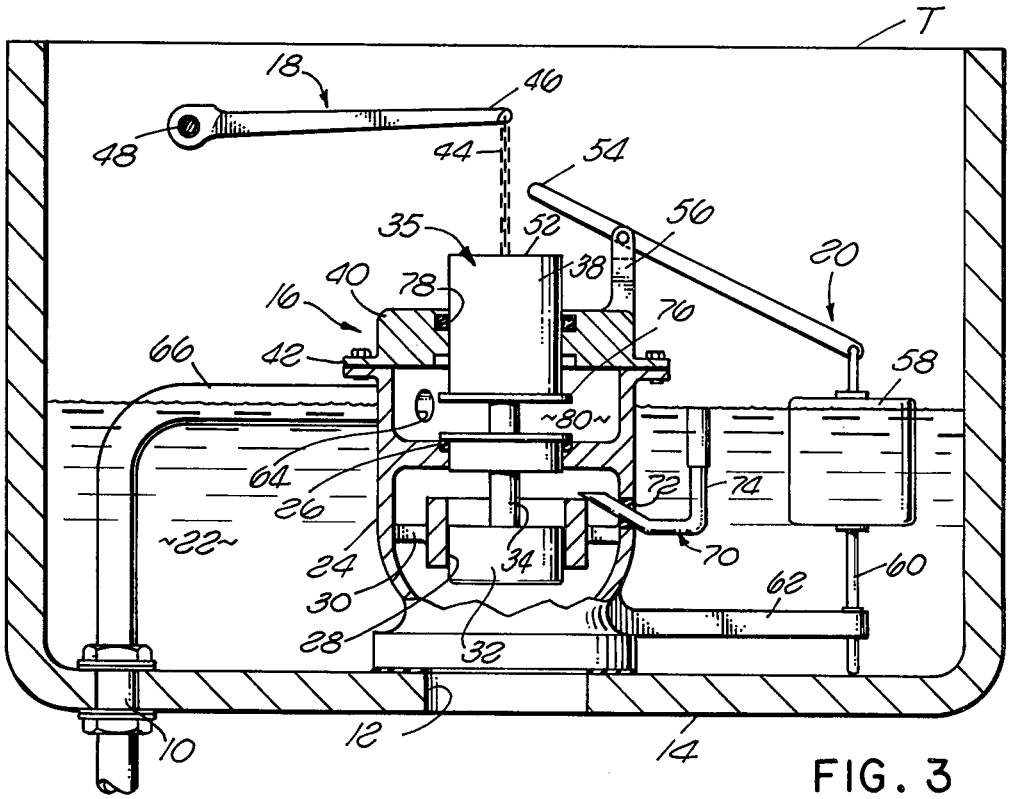
FIG. 3

TOILET FLUSHING VALVE MECHANISM

BACKGROUND AND SUMMARY OF THE INVENTION

A substantial variety of flushing mechanisms or valves have been proposed in the past for controlling the flow of flushing fluid, e.g. water, through a toilet. The following U.S. patents disclose examples of such mechanisms, most of which incorporate some type of valve:

U.S. Pat No. 274,186, Getchell
U.S. Pat. No. 647,411, Jenkins
U.S. Pat. No. 789,962, Callahan
U.S. Pat. No. 1,015,453, Moseley
U.S. Pat. No. 1,412,925, Curtis
U.S. Pat. No. 1,529,585, Gameson et al
U.S. Pat. No. 2,491,130, Owens
U.S. Pat. No. 2,492,436, Owens
U.S. Pat. No. 2,814,306, Ponsar
U.S. Pat. No. 3,164,847, Sorensen In spite of the variety of flushing mechanisms proposed in the past, for example, as set forth in the above patents, some difficulty continues to exist with respect to the operation of such apparatus in various forms. In general, most forms of the apparatus tend to leak or malfunction after substantial periods of use. Consequently, a need exists for an improved flushing mechanism for use in controlling the flow of flushing fluid, e.g. water, through a toilet.

In spite of the wide variety of flushing mechanisms that have been proposed in the past for use in toilets or water closets, one general class of apparatus has become quite conventional in the United States. Specifically, the conventional apparatus includes a valve which is controlled by a float to supply water from a pressurized source whenever the float drops below a predetermined level. In cooperation with such a control, the conventional apparatus includes a valve between the tank and the toilet bowl which valve is manually opened when the toilet is flushed and remains open substantially until the tank is drained into the toilet bowl. In the operation of such mechanisms, a substantial quantity of water normally flows into the tank from the water source (during the flushing operation) which may not be required for effective flushing. Conventionally, upon completion of the flushing operation (when the channel from the tank to the bowl is closed) a portion of the stream of water refilling the tank is bled off to return the water in the bowl to a desired threshold level of flushing. The somewhat independent operations of the conventional mechanism may be exceedingly wasteful of water which, from time to time, present a considerable problem in many locations. Consequently, a need exists for an improved flushing mechanism affording effective control and economic use of flushing water.

For commercial installations, where a water source with adequate flushing pressure usually is assured, another form of toilet flushing mechanism is widely used. Such installations do not employ a reservoir or tank but rather control flushing by the use of various hydraulic timers. The relatively critical nature of the water pressure for such flushing mechanisms sometimes presents a problem and also is a consideration with respect to some of the forms of flushing mechanisms that have been proposed to accomplish greater economy in the use of water. Accordingly, a need exists for a flushing mechanism which is durable, reliable, and which can be effectively operated within a wide variation of pressure for the source of the flushing water. The present invention may be embodied in a durable and reliable mechanism which may be employed for use with water sources of widely varying pressure and which may be operated with considerable economy of water.

BRIEF DESCRIPTION OF THE DRAWINGS

In the drawings, which constitute a part of this specification, an exemplary embodiment demonstrating the various objectives and features hereof is set forth as follows:

FIG. 1 is a front elevation of the tank portion of a toilet of the type in which the present invention is incorporated;

FIG. 2 is a top sectional view of the toilet tank of FIGURE 1 incorporating the mechanism of the present invention;

FIG. 3 is an offset vertical sectional view taken through the tank of FIG. 2; and FIG. 4 is a fragmentary view of FIG. 3 showing the operating mechanism in a different state.

DESCRIPTION OF ILLUSTRUTIVE EMBODIMENT

As indicated above, a detailed illustrative embodiment of the invention is disclosed herein. However, mechanisms may be embodied in accordance with various forms, some of which may be rather different from the disclosed illustrative embodiment. Consequently, the specific structural and functional details disclosed herein are merely representative, yet in that regard they are deemed to provide the best embodiment for purposes of disclosure and to provide a basis for the claims herein which define the scope of the present invention.

Referring initially to FIG. 1, the tank T of a conventional toilet is illustrated as it normally exists for supplying flushing liquid to a bowl (not shown). Generally, the tank T contains a reservoir of flushing water which is covered by a lid L. The lid L may be conveniently and easily removed not only for major repairs but also for minor adjustments or to release portions of the mechanism which sometimes bind or become locked together.

The tank T mounts a handle H by which flushing operations are initiated. In a conventional unit that is operating properly, the handle H is depressed actuating the apparatus first to flush the bowl then to refill both the tank and the bowl. Significantly, in the operation of the mechanism disclosed herein, actuation of the handle H initiates the flushing operation during which a predetermined volume of water is metered into the tank T. Then, at the conclusion of the flushing operation, the water from the tank T is released to refill the bowl leaving the tank somewhat depleted. The mechanism affords relatively precise control to attain effective flushing and a desired minimal liquid flow.

Turning now to a structural consideration of the disclosed embodiment herein, reference will be made somewhat simultaneously to FIGS. 2 and 3. In that regard, it may be seen that the tank T is of a somewhat parallelepiped configuration which is open at the top and defines a supply port 10 along with a discharge port 12 in the bottom 14. The flushing control mechanism 16 is somewhat centrally located in the tank T (FIG. 3) and is connected between the supply port 10 and the discharge port 12. At this stage of explanation, the mechanism 16 may be considered as a form of valve which is actuated manually by the handle H (FIG. 2) acting through a linkage 18 (FIG. 3) to initiate a flushing operation. A float mechanism 20 terminates the flushing operation, after which the bowl (not shown) of the toilet is filled to the threshold of another flushing operation by water from the reservoir 22 in the tank T.

Considering the valve unit or flushing mechanism 16 in somewhat greater detail, a base housing 24 is matingly affixed over the discharge port 12 of the tank T. The housing 24 defines an annular valve seat 26 at a central location which is concentric with a guide rim 28 that is carried on several radially extending spokes 30 which are integral with the housing 24. The rim 28 matingly receives a guide land or plunger 32 which is affixed by an axial rod 34 to a valve land 36 and a piston 38 which may be collectively considered as a spool valve. These elements are generally of cylindrical configuration having substantially uniform diameters and being held in concentric alignment by the rod 34. The piston 38 is matingly received through a housing cover 40 which is affixed to the housing 24 along abutting flanges 42.

The piston 38 is loosely coupled to the flushing linkage 18. Specifically, a chain 44 extends from the top of the piston 38 and is attached to a lever 46 which is supported on a rotary shaft 48 (FIG. 2) that is journalled through the tank T for connection to the handle H. The shaft 48 is held in place by a fastener 50.

Returning to the piston 38 (FIG. 3), it is to be noted that the upper surface 52 thereof will be forcefully contacted by a lever 54 which is pivotally supported on a yoke 56 that extends upwardly from the housing cover 40. The end of the lever 54 which is remote from the piston 38 is pivotally attached to a float 58 that moves vertically on a guide rod 60 supported by an arm 62 extending laterally from the base of the housing 24.

As indicated, the flow of flushing fluid through the housing 24 is from the bottom thereof through the discharge port 12. Intake to the housing 24 is through a lateral port 64 which is threadably coupled to a pipe 66 that in turn is coupled to a source of flushing fluid and extends through a seal 68 in the supply port 10.

Another fluid passage of the mechanism housing 24 is through a tube 70 which extends laterally and downward through a slidable adjustment seal 72, then external of the housing 24, turns upward in a vertical section 74. The section 74 is telescopic and serves to set the opening of the tube 70 at a desired level.

In view of the above preliminary structural description of the apparatus of the present invention, a complete understanding thereof may now best be accomplished by describing a cycle of operation while concurrently introducing other structural components. Accordingly, assume initially that the apparatus is in a quiescent state as depicted in FIG. 3, ready for flushing. In such a state, with the depression of the flushing handle H (FIG. 2) the shaft 48 is revolved lifting the lever 46 (FIG. 3) to raise the chain 44 and in turn displace the spool valve assembly 35 upwardly until a flange 76 on the piston 38 engages the interior of the cover 40. Note that a seal 78 between the piston 38 and the cover 40 is effective during all operations, to contain water within the housing 24.

Prior to the upward displacement of the spool valve 35, the valve was in a balanced state as a result of pressure in the chamber 80 exerting equal forces on the piston 38 and the valve land 36. However, upon the upward displacement of the valve land 36, the pressure in the chamber 80 is diminished because the valve land 36 is lifted from the seat 26 to the position depicted in FIG. 4 so that water may flow downwardly as indicated by arrows, i.e. outside the rim 28 through the housing 24 and into the toilet bowl (not shown).

The flow of water into the bowl elevates the level above the flushing threshold and as a consequence the bowl flushes. In that regard, the flow described above (from the source of flushing fluid through the mechanism 16) continues for a regulated time interval to sustain the flush. In general, the time interval is dependent upon the pressure of the water source and the adjustment of the tube 70. That operation will now be considered.

The flow of water from the port 64 through the chamber 80, the valve seat 26, and the discharge port 12 provides a stream, a portion of which is bled off to increase the volume of water in the reservoir 22. Specifically, a portion of the water passing through the housing 24 impacts upon the open end of the tube 70 to flow into the reservoir 22. As water flows into the reservoir 22, the water level raises, lifting the float 58 to ultimately act on the lever 54 to lower the plunger 32 back to the position depicted in FIG. 3 thereby closing the valve land 36 against the valve seat 26. At that time, the pressure again increases in the chamber 80; however, the spool valve assembly 35 remains as shown in FIG. 3, there being equal pressure exerted on the face of the valve land 36 and the end of the piston 38.

At the termination of flow from the pressurized water source through the flushing mechanism 16, the water in the bowl is depleted, having been used to accomplish the flushing operation. The water level in the bowl is restored to the threshold flushing level by water flowing from the reservoir 22 through the tube 70 back into the housing 24 and into the bowl (not shown) through the discharge port 12. Accordingly, the system is returned to the initially assumed quiescent state ready for another flushing operation.

As indicated above, the pressure in the chamber 80 is not critical as the spool valve assembly will remain in position within a wide range of pressure variations. As a consequence, the apparatus of the present invention can be effectively employed in installations of widely varying pressure. Some adjustment may be desirable and as indicated above, adjustment is afforded by manipulation of the tube 70 to variously penetrate the housing 24 and to attain various levels for the quiescent state of the reservoir 22 in the tank T.

As indicated above, the system of the present invention may be effectively employed with water sources of widely varying pressure levels. Also, the system may be seen to be readily durable and reliable in operation. Furthermore, the control sequence provided is such that considerable economy of water is accomplished in the flushing operation. Of course, the apparatus may be variously implemented and variously used depending upon designer criteria, installation, water pressure, and water cost. Accordingly, the scope hereof shall not be referenced to the disclosed embodiment but on the contrary, shall be determined in accordance with the calims as set forth below.

What is claimed is:

1. A toilet flushing valve mechanism for use in a tank connected to a source of flushing fluid under pressure, and defining an outlet to a bowl, comprising:

a housing defining an inlet port adapted to be connected to said source of flushing fluid and further defining a vertical valve chamber extending transverse to said inlet port, said chamber being coupled through said outlet to said bowl;

a multiple land spool valve positioned in said valve chamber and having spaced apart land means with said inlet port coupled to the space therebetween, one of said lands for mating with said chamber to close said outlet to said bowl;

activating means for displacing said spool valve to open said outlet to said bowl;

float means in said tank for moving said spool valve to close said outlet to said bowl under control of the water level in said tank; and a tube means, defining a passage from a location inside said vertical valve chamber and below said spool valve to a location outside said vertical valve chamber in said tank, said tube means for carrying a bleed-off flow from said inlet port when said spool valve is open during a flushing operation to raise the water level in said tank, said tube further defining an opening outside said vertical valve chamber at the normal water level in said tank to after fill said toilet with water from said tank received therein through the tube means during the flushing operation.

2. A valve mechanism according to claim 1 wherein said housing defines said valve chamber to provide a mating circular opening for each of said lands with open space therebetween.

3. A valve mechanism according to claim 1 wherein said spool valve includes at least one guide land.

* * * * *